US009206556B2

(12) United States Patent
Voelkerding et al.

(10) Patent No.: US 9,206,556 B2
(45) Date of Patent: Dec. 8, 2015

(54) ELEVATED FROG AND RAIL CROSSING TRACK ASSEMBLY

(71) Applicant: Cleveland Track Material, Inc., Cleveland, OH (US)

(72) Inventors: Dan Voelkerding, Cleveland, OH (US); James A. Remington, Sheffield Village, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 239 days.

(21) Appl. No.: 14/047,762

(22) Filed: Oct. 7, 2013

(65) Prior Publication Data

US 2014/0034788 A1 Feb. 6, 2014

Related U.S. Application Data

(62) Division of application No. 13/156,692, filed on Jun. 9, 2011, now Pat. No. 8,556,217.

(60) Provisional application No. 61/489,366, filed on May 24, 2011.

(51) Int. Cl.
*E01B 7/28* (2006.01)

(52) U.S. Cl.
CPC ..... *E01B 7/28* (2013.01)

(58) Field of Classification Search
CPC ..... E01B 7/28; E01B 7/00; E01B 7/16; E01B 7/30; E01B 7/12
USPC ..... 246/454, 465, 466, 467, 455, 57, 458, 246/462, 463, 464, 472, 456
See application file for complete search history.

(56) References Cited

U.S. PATENT DOCUMENTS

| | | | | | |
|---|---|---|---|---|---|
| 378,827 | A | * | 2/1888 | Crowell | 246/466 |
| 406,309 | A | * | 7/1889 | Samuel | 246/466 |
| 430,383 | A | * | 6/1890 | Hodskinson | 246/466 |
| 573,747 | A | * | 12/1896 | Wood | 246/466 |
| 908,351 | A | * | 12/1908 | Strickland | 246/463 |
| 1,430,178 | A | * | 9/1922 | O'Hern | 246/463 |
| 1,696,482 | A | * | 12/1928 | Hesskew et al. | 246/457 |
| 1,703,716 | A | * | 2/1929 | Botto | 246/466 |
| 1,811,129 | A | * | 6/1931 | Hesskew et al. | 246/457 |
| 4,015,805 | A | | 4/1977 | Friesenbichler | |
| 4,144,442 | A | | 3/1979 | Augustin et al. | |
| 4,159,090 | A | | 6/1979 | Pirker | |
| 4,168,817 | A | | 9/1979 | Pirker et al. | |
| 4,169,745 | A | | 10/1979 | Moser et al. | |
| 4,469,299 | A | | 9/1984 | Csontos | |

(Continued)

*Primary Examiner* — Mark Le
(74) *Attorney, Agent, or Firm* — Roger A. Gilcrest

(57) ABSTRACT

A crossing panel includes a pair of intersecting rails, a pair of crossing line rails, a plurality of railroad ties supporting the crossing line rails such that the crossing line rails are angled upwardly from a base elevation toward the respective main line rail and terminating such that a tread bearing surface of each crossing line rail at its terminal end is at a height above the crown of the intersecting line rail, an external frog casting being aligned with and secured to the terminal ends of the crossing line rails and having an external frog tread bearing surface substantially above the crown of an intersecting line rail, and transitional guide castings disposed between the intersecting rails and respectively aligned with the crossing line rails. The transitional guide castings are substantially horizontal, and each has a crown maintained at a height sufficient to maintain a railcar wheel of a train wheel set above the intersecting line rails.

16 Claims, 9 Drawing Sheets

(56) References Cited

U.S. PATENT DOCUMENTS

| | | | | |
|---|---|---|---|---|
| 4,514,235 | A | 4/1985 | Augustin et al. | |
| 4,516,504 | A | 5/1985 | Brems et al. | |
| 4,589,617 | A | 5/1986 | Kempa | |
| 4,624,428 | A | 11/1986 | Frank | |
| 4,637,578 | A | 1/1987 | Frank | |
| 4,756,477 | A | 7/1988 | Schumaker | |
| 4,908,993 | A | 3/1990 | Buhler | |
| 4,948,073 | A | 8/1990 | Edwards et al. | |
| 4,953,814 | A | 9/1990 | Oswald et al. | |
| 4,982,919 | A | 1/1991 | Durchschlag et al. | |
| 5,042,755 | A | 8/1991 | Testart | |
| 5,082,214 | A | 1/1992 | Testart | |
| 5,184,791 | A | 2/1993 | Kais et al. | |
| 5,375,797 | A | 12/1994 | Willow | |
| 5,522,570 | A | 6/1996 | Benenowski et al. | |
| 5,531,409 | A | 7/1996 | Willow | |
| 5,544,848 | A | 8/1996 | Kuhn et al. | |
| 5,560,571 | A | 10/1996 | Remington | |
| 5,595,361 | A | 1/1997 | Remington et al. | |
| 5,598,993 | A | 2/1997 | Kuhn et al. | |
| 5,743,496 | A | 4/1998 | Atkinson, Jr. | |
| 5,782,437 | A | 7/1998 | Irie et al. | |
| 5,806,810 | A | 9/1998 | Young et al. | |
| 5,810,298 | A | 9/1998 | Young et al. | |
| 5,845,881 | A * | 12/1998 | Young et al. | 246/457 |
| 6,138,958 | A | 10/2000 | Irie et al. | |
| 6,158,697 | A | 12/2000 | Young et al. | |
| 6,164,602 | A | 12/2000 | Kuhn et al. | |
| 6,177,205 | B1 | 1/2001 | Kais et al. | |
| 6,224,023 | B1 | 5/2001 | Young et al. | |
| 6,266,866 | B1 | 7/2001 | Ramirez et al. | |
| 6,276,642 | B1 | 8/2001 | Young et al. | |
| 6,286,791 | B1 | 9/2001 | Young et al. | |
| 6,340,140 | B1 | 1/2002 | Lochschmidt | |
| 6,543,728 | B1 | 4/2003 | Benenowski et al. | |
| 6,732,980 | B2 | 5/2004 | Hein | |
| 6,971,610 | B2 * | 12/2005 | Hein et al. | 246/465 |
| 6,994,299 | B2 | 2/2006 | Marron | |
| 7,083,149 | B2 | 8/2006 | Heinze et al. | |
| 7,121,513 | B2 | 10/2006 | Leitner | |
| 7,377,471 | B1 | 5/2008 | Compton et al. | |
| 2004/0065784 | A1 | 4/2004 | Hein | |
| 2004/0124316 | A1 | 7/2004 | Marron | |
| 2005/0067535 | A1 | 3/2005 | Leitner | |
| 2005/0145754 | A1 | 7/2005 | Heinze et al. | |
| 2006/0202047 | A1 | 9/2006 | Klauder | |
| 2007/0007394 | A1 | 1/2007 | Hein et al. | |
| 2010/0270436 | A1 | 10/2010 | Wientges et al. | |

* cited by examiner

ELEVATED FROG AND RAIL CROSSING TRACK ASSEMBLY

RELATED APPLICATION DATA

This application is a divisional of U.S. patent application Ser. No. 13/156,692, filed Jun. 9, 2011, now U.S. Pat. No. 8,556,217, which claims the priority benefit of U.S. Provisional Application Ser. No. 61/489,366, filed May 24, 2011, which are hereby incorporated in their entirety herein by reference.

FIELD OF THE INVENTION

The present invention relates to a railroad track and crossing assemblies.

BACKGROUND OF THE INVENTION

The present invention relates to a crossing assembly for a railway crossing panel. A railway crossing is employed where one track crosses another.

Typically, railroad crossing components are the some of the highest maintenance portions of a railroad track arrangement as they must endure repetitive impact and stress.

In prior art arrangement, relatively large frog castings are used to lift the wheels to a height necessary to allow the wheels of a train to cross a main line rail. When the wheels cross the gap they generate impacts that adversely affect the frog, wheels, and the track structure. Although each of the foregoing designs is workable, an improved design that further reduces the railroad maintenance would be desirable.

In providing for rail crossing, it is important to accommodate several aspects relating to the main line running and turn out rail line.

In order to allow the train car wheel set to cross over a main line rail, it must be raised to a height to allow it to cross the near main running rail, maintained securely at that height to cross the far main running rail and then securely returned to the base running height along the rail course and without causing excessive repetitive bounce typically experienced in prior crossing arrangements.

Typically this is accomplished by using a frog casting disposed between and on either side of the main line rails. These castings are designed to lift the wheel, direct it through the transition zone over both main line rails, and capture the wheel, allowing it to relax to the established rail elevation. For these purposes, the dual frogs are specially cast and custom machined to provide the required shaping, such as that to provide the required ramping and channeling for support and capture of the wheel tread and flange, to be able to firmly and accurately provide mechanical action under high strain and impact conditions.

It is also typical that frog designs accommodate canted main running rails used in higher speed track sections, such as those that may accommodate mainline speeds of 50-60 mph. The canted mainline running rail is rotated laterally toward the opposite mainline running rail at a 1:40 angle (1:40 cant being a railroad standard). Likewise, the external and internal frog castings may likewise incorporate a cant, also at the same angle, such as the 1:40 angle, with all the frog castings normally having the same base level. Canting the rail through the frog design provides a continuous wheel to rail contact path through the frog and eliminates the "rock-and-roll" effect that can be present in some operating conditions.

It is advantageous to be able to provide this mechanical action with reduced expense and effort associated with the production of relatively expensive multiple castings that require custom machining that are customary in the industry. In this regard, frog castings typically incorporate ramping in the design of the main body casting that require rather complex post-casting machining, and it is beneficial to reduce or eliminate complex ramping within the body of the casting.

It is also best to provide a uniform, unbroken wheel path that distributes load and reduces wheel and frog wear, such as may be accomplished by providing a horizontal or otherwise linearly regular wheel path that is not interrupted by wheel-to-rail interface.

Typically frog casting systems must incorporate all of the required ramping with the length of the casting, which requires relatively larger castings to distribute the ramping length to reduce inertial bounce as the wheel sets pass over the main line rail. This makes typical frog casting systems relatively large and expensive. Accordingly, it would be beneficial to reduce the overall casting size, and thereby reduce the initial cost of frog production while at the same time reducing the cost of attendant repair and maintenance.

It is also beneficial to provide a crossing system that may be made and installed simply, while also being adapted for prefabrication and installation, and one that is relatively easy to assemble and repair. In this regard, it is desirable to eliminate multiple castings, make their production easier and less expensive, and provide frog panels that are adapted to reduce overall track and crossing wear associated with long term use, and that accommodate changes in wheel geometry as wheel degradation occurs over the wheel's operational life cycle.

The embodiments of the invention described herein addresses the shortcomings of the prior art.

SUMMARY OF THE INVENTION

In general terms, the invention may be described as including a crossing panel assembly for a railway intersection, as well as a rail intersection design and a frog casting therefor. The present invention may be used for single and multiple crossings as will be appreciated from the description and drawings.

The present invention may be characterized as a frog containing panel system, and the frog and rail intersection used therein.

The present invention thus provides several concomitant advantages over the prior art. The system of the present invention allows the required ramping for the approaching wheel set to be incorporated into the rail portion of the design outside the main body casting, so as to eliminate the need for a toe-side frog casting, and consequently eliminates the need for ramping within the body of such a toe-side frog casting, thus reducing the wear on the casting and attendant need for replacement over time. This reduces initial and operational costs.

By using the run-up rail section of the rails within the panel to raise the on-coming wheel set, the length of the ramping can be extended so the slope is more gradual so as to offer greater operating speed but still within the industry guidelines as reflected in Transportation Research Board Research Report 57. This also removes the need for relatively large lift frog casting of substantial size that would be required otherwise.

The present invention also includes ramped rails extending from the transition zone above the main line rails. This also minimizes the extent to which the decline of the raised wheel set, following passage through the transition zone, must be borne by downstream frog castings. Accordingly, the present invention allows one to minimize the size of the frog castings, as well as make the frog easier and less expensive to machine. It also reduces overall wear on component parts and reduces panel maintenance costs.

The present invention also includes a crossing panel system which may be assembled as a complete unit at a manufacturing site and transported to its intended installation site. This allows for greater control manufacturing costs and allows the operator to obtain a completed crossing panel that may be produced using relatively small and simple frog castings that can be installed on site.

In operation, the system of the present invention also provides for an unbroken wheel path that is substantially a horizontal or otherwise linearly regular wheel path and that is not interrupted by wheel to rail interface.

Rail crossing systems of the present invention may be incorporated with canted rail systems that allow for speeds as high as 50-60 mph where desirable.

The several aspects of the present invention may be summarized as follows.

Lift Frog Crossing Panel with Single Intersecting Line and Angled Main Line Rails with Lift Frogs on One Side In general terms the present invention includes a crossing panel for accommodating the rolling of wheels of a railcar wheel set of a train, each wheel having a flange and a tread surface, upon crossing line rails and over an intersecting pair of main line rails, the crossing panel comprising: (a) a pair of crossing line rails, each crossing line rail having a crossing rail tread bearing surface and a terminal end; (b) a pair of main line rails intersecting the crossing line rails and comprising a first main line rail and a second main line rail, each having a crown, and defining a transition zone thereabove; (c) a plurality of railroad ties adapted to support the crossing line rails; the crossing line rails supported by the ties and angled upwardly from the base elevation toward the first main line rail and terminating such that their tread bearing surface at their respective terminal ends is at a height above the crown of the first main line rail; (d) an external frog, being aligned with and secured to each the respective terminal ends of the crossing line rails, each external frog having an external frog tread bearing surface at substantially above the first main line rail crown, each external frog having a flange pathway having a transitional flangeway adapted to engage the flange of a railcar wheel of a train wheel set passing therethrough, such that the tread (and thereby the flange) of the wheel is substantially above the level of the first main line rail crown and contacts the external frog tread bearing surface; and (e) an internal casting disposed between the pair of main line rails and respectively aligned with each of the crossing line rails, the internal castings being substantially horizontal and each having a crown maintained at a height sufficient to maintain the railcar wheel of a train wheel set above the main line rails.

The invention may be characterized in that a substantial portion, and preferably the majority, if not all of the rise of the crossing wheel set is brought about by the crossing line rails being angled upwardly from the horizontal (or other base elevation where the non-crossing rails are running at an incline) toward the first main line rail and terminating such that their tread bearing surface and flange once reaching the terminal ends is at a height above the crown of the first main line rail. That is, preferably at least 80%, preferably 90% and most preferably 100% of the rise of the crossing wheel set is brought about by the crossing line rails being angled upwardly from the horizontal (or base elevation).

It is preferred that the main rails are canted toward one another, and that the frog is shaped so as to accommodate the main rail cant angle. The crossing rails and the external frog castings may also be canted and wherein the frog tread bearing surface is disposed at an angle so as to accommodate the canting of the crossing rail segment.

It is preferred that the plurality of railroad ties having a series of at least two ties disposed beneath the pair of crossing line rails, the series of ties being provided with respective riser plates adapted to maintain the pair of crossing line rails angled from the horizontal and upward toward the first main line rail. In this variation, it is also preferred that the respective riser plates are adapted to maintain the crossing line rails in a canted position. The rail cant may be maintained through the transition zone by having the transitional guide castings be canted toward one another.

The transitional guide castings may further comprise a guard portion disposed along one side thereof for retaining a train wheel in a proper position with respect to the transitional guide castings as it moves through the transition zone.

Such a system has the advantage of featuring a frog that is relatively smaller and easier to machine as it requires less complex shaping and machining of channels and flangeways.

The system may preferably be produced by incorporating a plurality of railroad ties having a series of at least two ties disposed beneath the leading portion of the crossing rail, the series of ties being provided with respective riser plates adapted to maintain the run-up portion of the crossing rails angled from the horizontal. The plurality of railroad ties also preferably features a series of at least two ties disposed beneath the trailing portion of the crossing rails downstream of the transition zone, the series of ties being provided with respective riser plates adapted to maintain the trailing portion of the outer side rail angled from the horizontal. The riser system allows vertical bends to be incorporated into the run-up and run-off crossing rail portions, as well as to maintain the wheel sets in a substantially horizontal run line through the transition zone.

The frog preferably comprises a base surface and a tread bearing surface, the frog tread bearing surface being flat substantially along its longitudinal axis, and the base surface adapted to maintain the frog tread bearing surface substantially horizontal when the base surface is placed upon a flat supporting surface.

Lift Frog Crossing with Single Intersecting Line and Angled Crossing Line Rails with External Frog Castings on Both Sides The present invention also includes a crossing panel for accommodating the rolling of wheels of a railcar wheel set of a train, each wheel having a flange and a tread surface, across a crossing point of crossing line rails over an intersecting pair of rails, where the crossing line is at a base elevation, the crossing panel comprising: (a) a pair of intersecting rails comprising a first intersecting line rail and a second intersecting line rail, each having a crown, and defining a transition zone thereabove; and, on either side of the pair of intersecting rails and approaching respective both the first intersecting line rail and the second intersecting line rail, a crossing line rail set comprising: (i) a pair of crossing line rails, each the crossing line rail having a crossing rail tread bearing surface and a terminal end; (ii) a plurality of railroad ties adapted to support the crossing line rails; the crossing line rails supported by the ties and angled upwardly from the base elevation toward the respective main line rail and terminating such that its tread bearing surface at its terminal end is at a height above the crown of the respective intersecting line rail; and (iii) an external frog casting being aligned with and secured to the respective terminal ends of the crossing line rails, each external frog casting having an external frog tread bearing surface substantially above the level of the first main line rail crown, each external frog having a flange pathway to engage the flange of a railcar wheel of a train wheel set passing therethrough, such that the flange of the wheel is above the level of the respective intersecting line rail crown; and (b) transitional guide castings disposed between the pair of intersecting rails and respectively aligned with the crossing line rails, the transitional guide castings being substantially horizontal and each having a crown maintained at a height sufficient to maintain the railcar wheel of a train wheel set above the crossing line rails.

Preferably, the main rails are canted toward one another, and that the frog is shaped so as to accommodate the main rail cant angle. The crossing rails and the external frog castings may also be canted and wherein the frog tread bearing surface is disposed at an angle so as to accommodate the canting of the crossing rail segment. The external frog castings may be shaped and adapted to maintain each set of crossing line rails angled from the horizontal or other base elevation, as well as to accommodate the canting of the crossing rails.

Likewise, the respective riser plates are adapted to maintain the crossing line rails in a canted position where desired, and the transitional guide castings may also be provided with running surfaces that are canted toward one another. The transitional guide castings preferably are further provided with a flange pathway having a raised guard portion disposed along one side thereof for retaining a train wheel in a proper position with respect to the transitional guide castings.

Lift Frog Crossing with Dual Intersecting Lines and Angled Crossing Line Rails with External Frog Castings on Both Sides and Bridging Rail Sections Between Intersecting Rail Pairs Also included in the present invention is a crossing panel for accommodating the rolling of wheels of a railcar wheel set of a train, each wheel having a flange and a tread surface, across a crossing point of crossing line rails over an intersecting pair of two main line rails, where the crossing line is at a base elevation, the crossing panel comprising: (a) a first pair of main line rails comprising a first main line rail and a second main line rail, each having a crown, and defining a first transition zone thereabove; (b) a second pair of main line rails comprising a third main line rail and a fourth main line rail, each having a crown, and defining a second transition zone thereabove; the first pair of main line rails and the second pair of main line rails being substantially parallel and the first intersecting line rail and fourth intersecting line rail being in the outer position; (c) a crossing line rail set approaching respective each of the first main line rail and the fourth main line rail, each crossing line rail set comprising: (i) a pair of crossing line rails, each crossing line rail having a crossing rail tread bearing surface and a terminal end; (ii) a plurality of railroad ties adapted to support the crossing line rails; the crossing line rails supported by the ties and angled upwardly from the base elevation toward the respective main line rail and terminating such that its tread bearing surface at its terminal end is at a height above the crown of the respective main line rail; and (iii) a pair of external frogs, each external frog being aligned with and secured to the respective terminal ends of the crossing line rails, each external frog having a external frog tread bearing surface substantially above the level of its respective intersecting line rail crown, each external frog having a flange pathway to engage the flange of a railcar wheel of a train wheel set passing therethrough, such that the flange of the wheel is above the level of the respective intersecting line rail crown; (d) transitional guide castings disposed between each of the first and second pair of intersecting main line rails and respectively aligned with the crossing line rails, the transitional guide castings being substantially horizontal and each having a crown maintained at a height sufficient to maintain the tread and flange of the railcar wheel of a train wheel set above the main line rails; and (e) bridging rail sections disposed between the second and third intersecting rails and aligned with the crossing line rails, the bridging rail sections being substantially horizontal and each having a crown maintained at a height sufficient to maintain the railcar wheel of a train wheel set above the crossing line rails.

The main rails, crossing rails and external frog castings may also be canted in this embodiment as described herein, and the riser plates may likewise be adapted to maintain the crossing line rails in a canted position where desired, and the transitional guide castings may also have canted running surfaces and having a raised guard portion disposed along one side thereof for retaining a train wheel in a proper position with respect to the transitional guide castings.

Preferably, the bridging rail sections have bridging rail terminal ends and, associated with each bridging rail terminal end, a bridging rail frog, each bridging rail frog being aligned with and secured to the respective bridging rail terminal end, each bridging rail frog having a bridging rail frog tread bearing surface at substantially the same level of the intersecting rails, each bridging rail frog having a bridging flangeway.

It will be understood that all disclosed features of the present invention may be utilized to the extent that they are not logically inconsistent with one another.

DETAILED DESCRIPTION OF THE PREFERRED EMBODIMENTS

Figure 1:
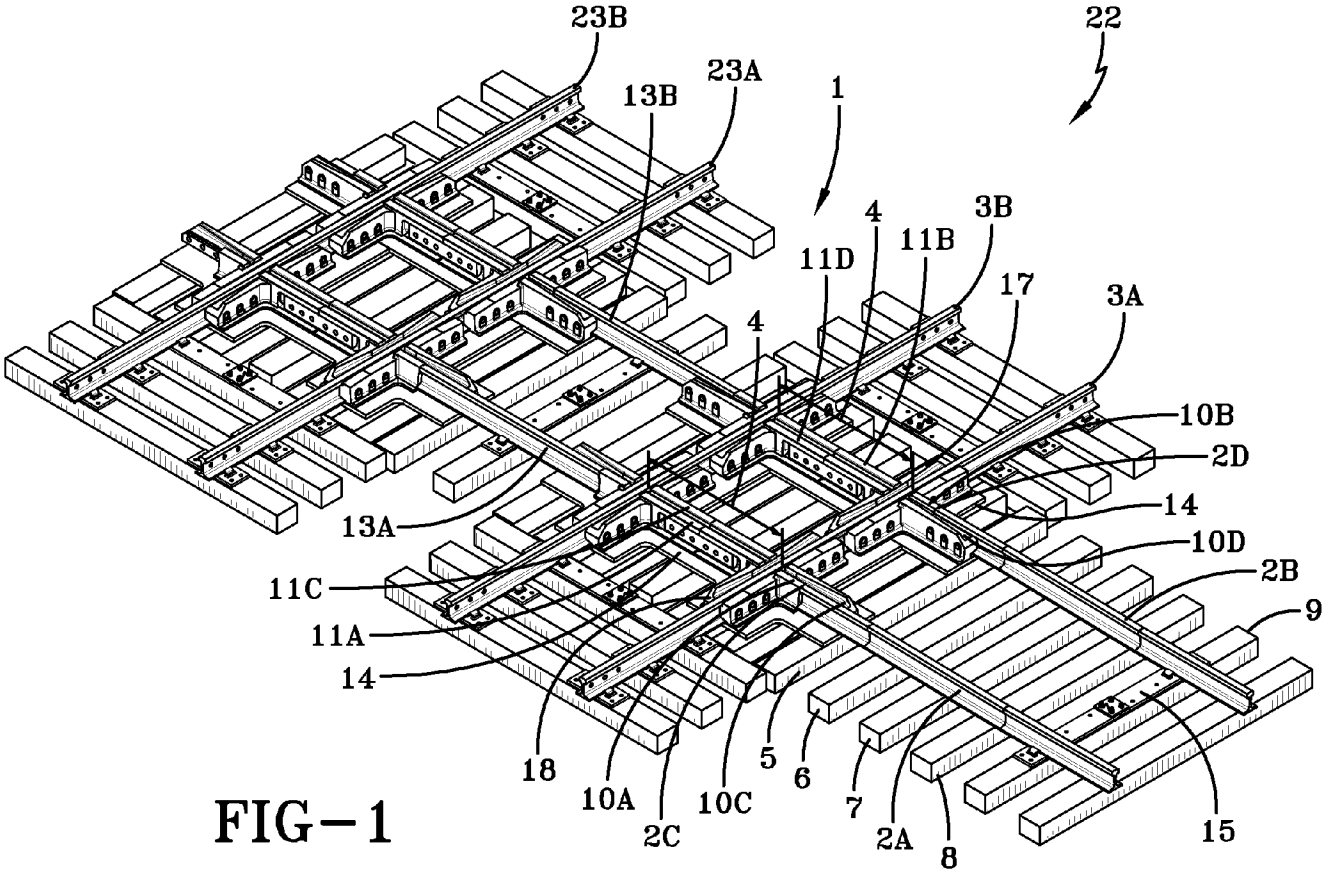
FIG. 1 is an upper perspective view of a crossing panel in accordance with one embodiment of the present invention.

In accordance with the foregoing summary, the following describes a preferred embodiment of the present invention which is considered to be the best mode thereof. With reference to the drawings, the invention will now be described in detail with regard for the best mode and preferred embodiment.

FIGS. 1-9 show, using like reference numerals, a rail crossing track assembly in accordance with one embodiment of the present invention.

FIG. 1 is an upper perspective view of a crossing panel in accordance with one embodiment of the present invention. This crossing panel is presented as a 90 degree angle crossing, though the present invention may be adapted and applied to other non-right-angle crossing applications.

FIG. 1 shows a crossing panel 1 for accommodating the rolling of wheels of a railcar wheel set of a train (each wheel having a flange and a tread surface) across a crossing point of crossing line rails 2*a* and 2*b* over an intersecting pair of main rails 3*a* and 3*b*. The crossing panel 1 comprising generally: a pair of crossing line rails, each crossing line rail having a crossing rail tread bearing surface and a terminal end, i.e., 2*c* and 2*d*, respectively. The pair of main line rails 3*a* and 3*b* intersecting the course of the crossing line rails 2*a* and 2*b* and comprising what is referred to herein for reference purposes a first main line rail 3*a* and a second main line rail 3*b*, each having a crown, and defining a transition zone 4 thereabove.

The crossing panel 1 also comprises a plurality of railroad ties, such as railroad ties 5-9, that adapted to support the crossing line rails 2*a* and 2*b*, such that the crossing line rails 2*a* and 2*b* supported by ties 5-9 are angled upwardly from the horizontal toward the first main line rail 3*a*, and terminating such that their tread bearing surfaces at their respective terminal ends is at a height above the crown of the first main line rail. This feature allows for the upwardly angled crossing line rails 2*a* and 2*b* to perform substantially all of the lift function over a length of approximately 5-10 tie lengths, though a greater or lesser run may be used in other applications. This feature allows the crossing wheels to be raised to a height sufficient to allow the wheels to be raised to cross the main line rails without reliance upon large castings that are relatively expensive to manufacture, maintain and replace over time. Expressed independently in other terms, the preferred embodiments of the present invention provide an arrangement such that from about 60 to about 100 percent (more preferably about 85 to about 100 percent, and most preferably about 95 to about 100 percent) of the vertical lift required to allow the wheels to clear the first main rail encountered by the crossing rail is accomplished by the vertical angling of the crossing rail itself.

The crossing rails preferably are canted toward one another to accommodate higher speeds.

Also shown in FIG. 1 are the external frogs 10*a* and 10*b* that are aligned with and secured to each the respective terminal ends 2*c* and 2*d* of the crossing line rails 2*a* and 2*b*. The external frogs 10*a* and 10*b* having an external frog tread bearing surface at substantially above the first main line rail crown as a continuation of the respective tread bearing surfaces of crossing line rails 2*a* and 2*b*. It is preferred that the external frogs have a flange pathway, i.e., flangeways 10*c* and 10*d*, that are adapted to engage the flange of a railcar wheel of a train wheel set passing therethrough, such that the tread of the wheel is substantially above the level of the first main line rail crown and contacts the external frog tread bearing surface, as may be appreciated from the Figures.

FIG. 1 also shows the internal castings 11*a* and 11*b* disposed between the pair of main line rails 3*a* and 3*b*, and respectively aligned with each of the crossing line rails 2*a* and 2*b*. The internal castings 11*a* and 11*b* are substantially horizontal and each has a crown maintained at a height sufficient to maintain the railcar wheel of a train wheel set above the main line rails 3*a* and 3*b*.

In a preferred embodiment, the panel 1 may also feature a plurality of railroad ties 5-9 having a series of at least two ties disposed beneath the pair of crossing line rails 2*a* and 2*b*, with the series of ties being provided with respective riser plates (such as riser plate 15) adapted to maintain the pair of crossing line rails angled from the horizontal (base elevation) and upward toward the first main line rail. This is shown in greater detail in FIGS. 7, 8 and 9. In an alternative embodiment, the crossing line rails 2*a* and 2*b* may be maintained angled from the horizontal and upward toward the first main line rail though the use of shaped ties, such as concrete ties that may be arrayed in the panel arrangement to support the crossing line rails 2*a* and 2*b* at the prescribed angle.

Where the crossing line rails are canted toward one another, the respective riser plates are adapted to maintain the crossing line rails in a canted position by being shaped to accommodate a canting angle as well as the vertical angle from the horizontal.

In the same manner, the pair of external frog castings external frogs 10*a* and 10*b* may be canted toward one another, and matched with the respective terminal ends 2*c* and 2*d* of the crossing line rails 2*a* and 2*b*. Likewise, the transitional internal castings 11*a* and 11*b* guide castings may be canted toward one another to maintain the beneficial effect of the canted rails throughout the transition zone 4.

The transitional internal castings 11*a* and 11*b* may further comprise raised guard portions 11*c* and 11*d* disposed along one side thereof for retaining a train wheel in a proper position with respect to the transitional guide castings. These raised guard portions 11*c* and 11*d* are aligned with the respective casting portions defining flangeways 10*c* and 10*d* to provide continuity of the rail paths and corresponding flangeways.

FIG. 1 also shows panel support plate(s) such as 14 that may be disposed upon the panel tie array for additional support and to assist in affixing the entire rail and casting assembly of the panel to panel tie array.

The panel of the present invention may be a single crossing with crossing rails, corresponding to and aligned with crossing line rails 2*a* and 2*b*, approaching from the opposite side of main line rails 3*a* and 3*b*, and provided with the associated external castings and supportive ties providing the vertical angles to the rails.

The embodiment shown in FIG. 1 shows the additional structure that may be used to render the invention in a dual crossing application.

FIG. 1 also shows additional optional bridging rail sections 13*a* and 13*b* having bridging rail terminal ends, such as 13*c* and 13*d*, and, associated with each the bridging rail terminal end, a bridging rail frog, such as 16*a* and 16*b*, each bridging rail frog being aligned with and preferably secured to the respective bridging rail terminal end, as shown. Each bridging rail frog has a bridging rail frog tread bearing surface at substantially the same level of the crossing rails. It is also preferred that the bridging rail frogs have a flange pathway having a transitional flangeway, i.e., flangeways 16*c* and 16*d*, that are adapted to engage the flange of a railcar wheel of a train wheel set passing therethrough, such that the tread of the wheel is substantially above the level of the main line rail crowns and contacts the bridging rail frog tread bearing surface, as may be appreciated from the other Figures.

Additionally, the panel may also incorporate additional lateral casting pieces that serve as wheel guides 17 and 18 along the main line rails 3*a* and 3*b* to provide secure travel guidance for the wheels as the move through the crossing area.

FIG. 1 also shows a second set of main line rails 23*a* and 23*b* which are provided on a second crossing panel 22 that is constructed in the same way as panel 1.

Figure 2:
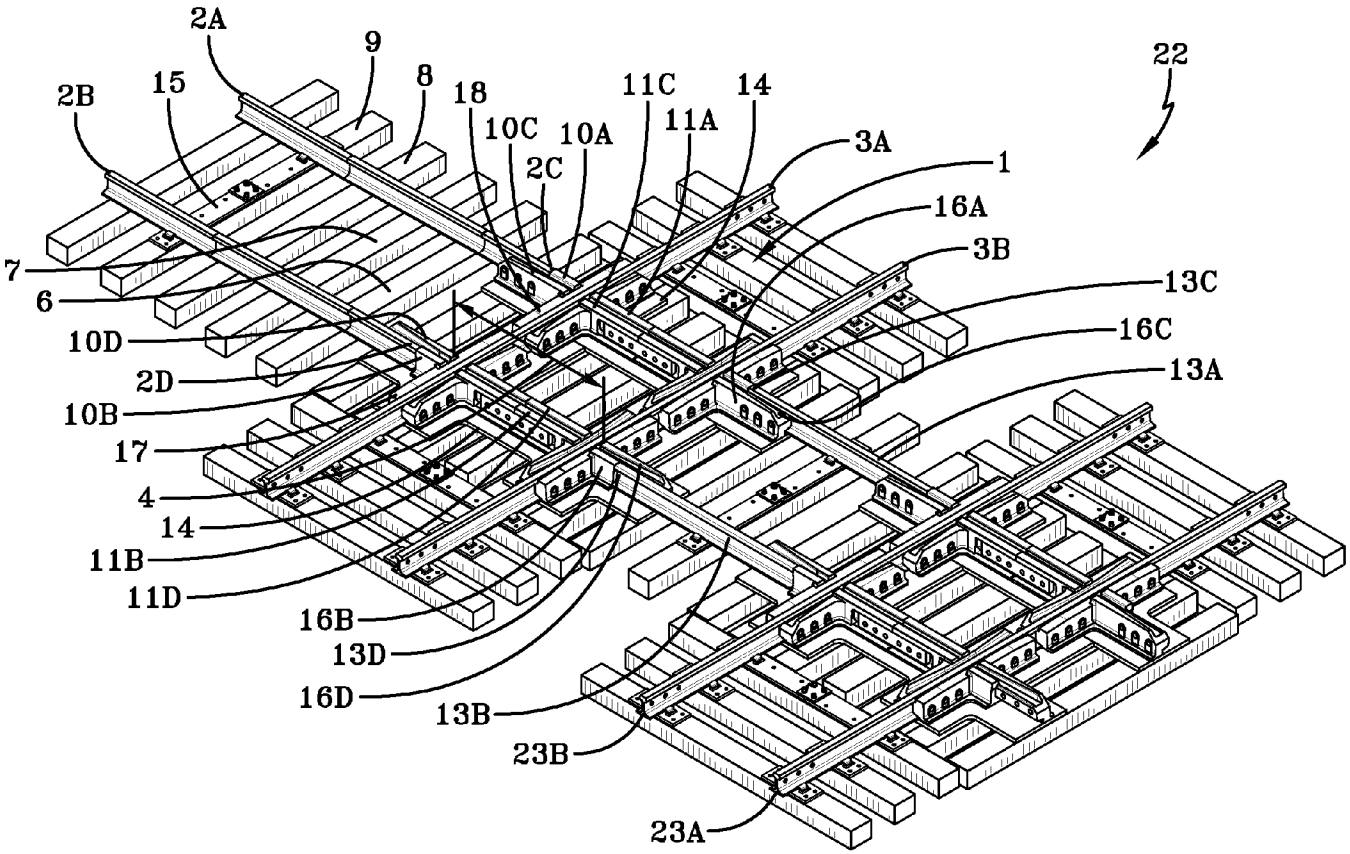
FIG. 2 is an upper perspective view of a crossing panel in accordance with one embodiment of the present invention.

FIG. 2 shows an upper perspective view opposite that shown in FIG. 1, and showing panels 1 and 22 wherein like reference numerals refer to the same portions described herein, and showing the construction of panel 22 and its interconnection to panel 1 through bridging rail sections 13*a* and 13*b* and associated bridging rail frogs, such as 16*a* and 16*b* and their corresponding castings on the opposite ends of bridging rail sections 13*a* and 13*b*. As can be appreciated from this view, bridging rail frogs 16*a* and 16*b* may be provided with flangeways 16*c* and 16*d* to provide continuity of the rail paths by being aligned with the space between transitional internal castings 11*a* and 11*b* and raised guard portions 11*c* and 11*d*, as well as with the corresponding flangeways 10*c* and 10*d* of the external frog castings.

Figure 3:
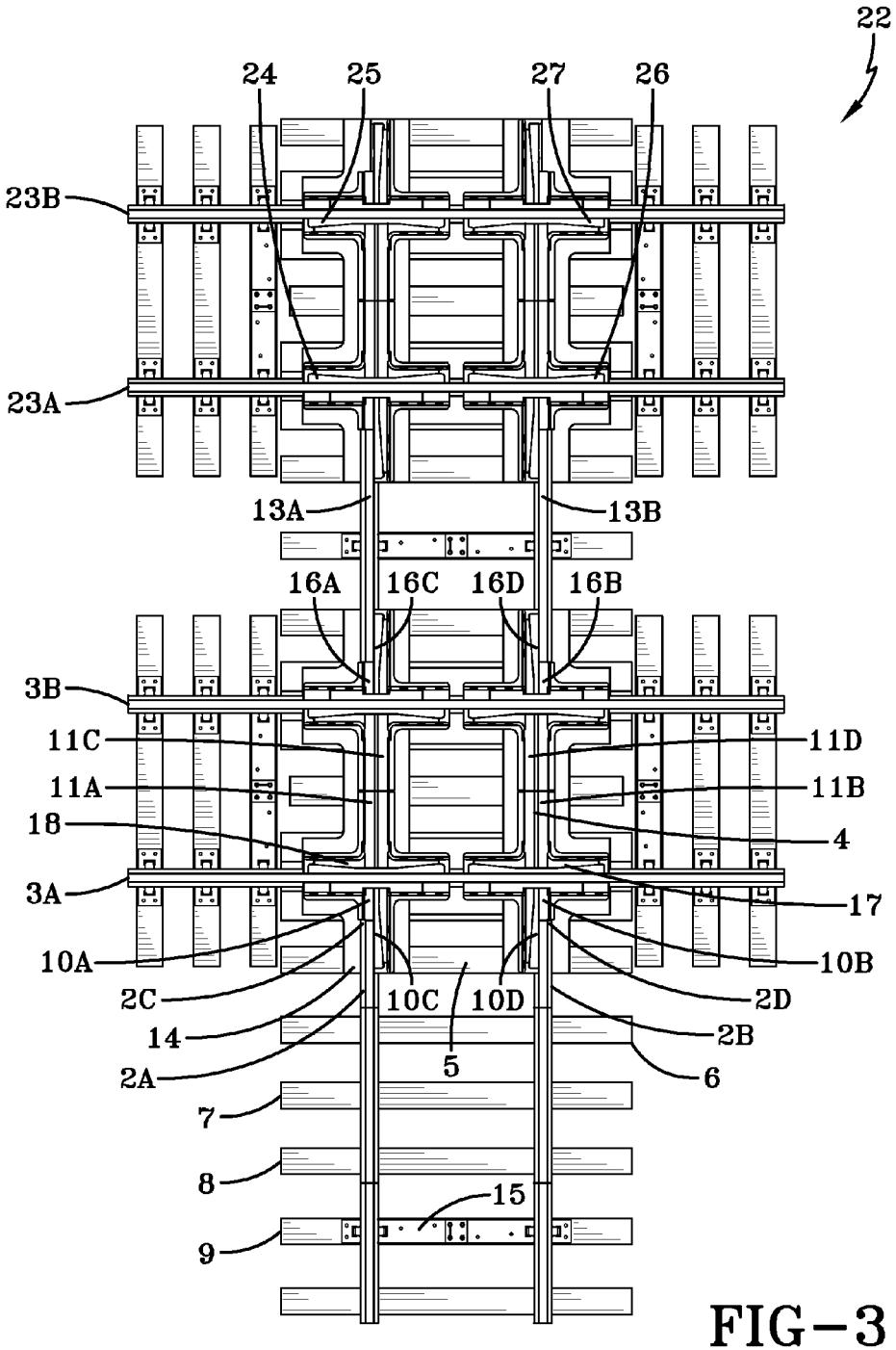
FIG. 3 is a top plan view of a crossing panel in accordance with one embodiment of the present invention.

FIG. 3 shows a top plan view of the panels 1 and 22 as shown in FIGS. 1 and 2, and wherein like reference numerals refer to the same portions described herein.

Figure 4:
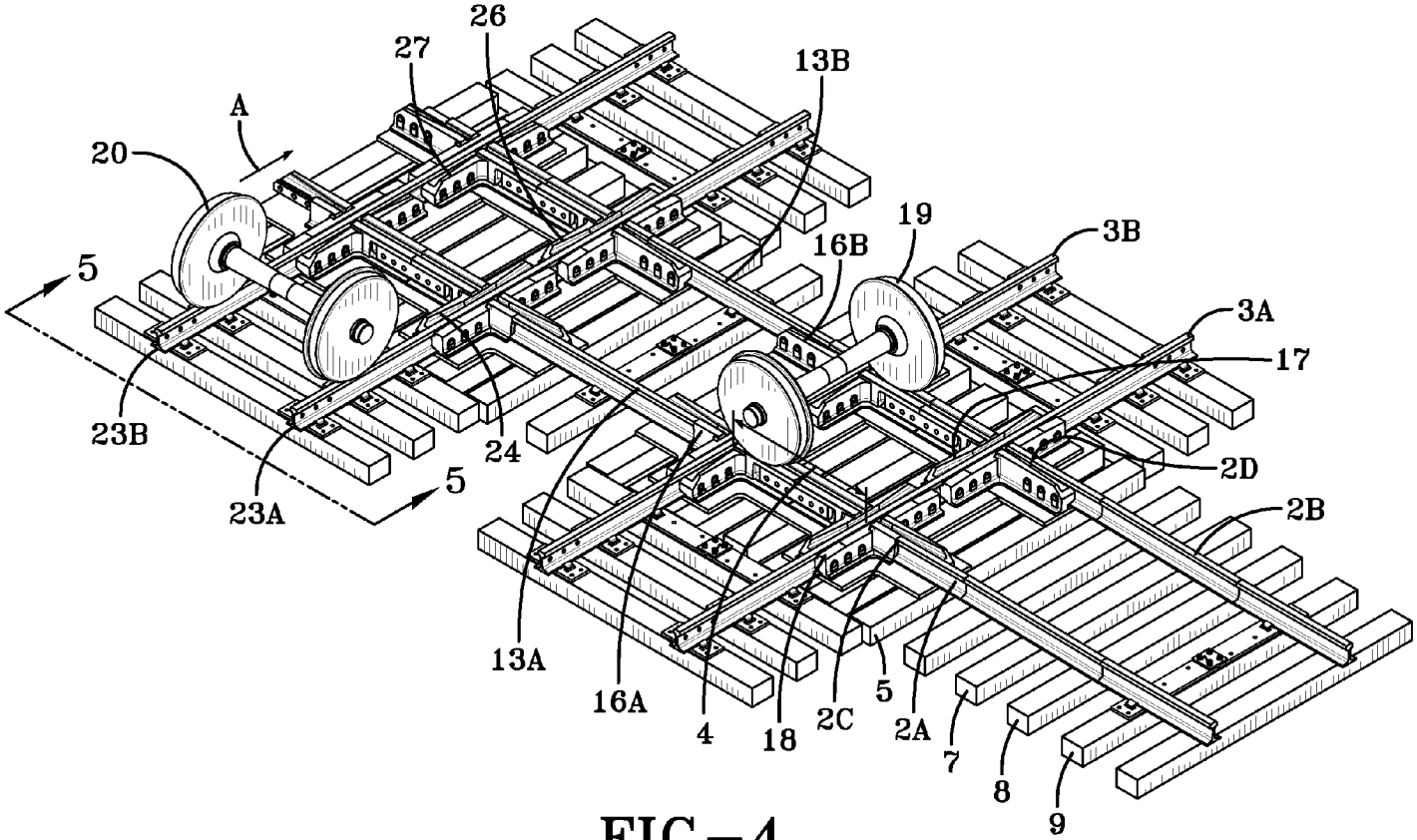
FIG. 4 is a detailed upper perspective view of a crossing panel in accordance with one embodiment of the present invention, and showing rail wheel sets in place.

FIG. 4 is a detailed upper perspective view of a crossing panel in accordance with one embodiment of the present invention, showing rail wheel sets 19 and 20 in place, and wherein like reference numerals otherwise refer to the same portions described herein. FIG. 4 presents an upper perspective view similar to that shown in FIG. 1, and shows panels 1 and 22 in cooperative operation with respect to rail cars as would be borne in part on rail wheel sets 19 and 20. This view shows rail car wheel set 19 in the transition zone 4 and being borne by transitional internal castings 11*a* and 11*b* while held in place by raised guard portions 11*c* and 11*d*. Also shown are rail car wheel set 20 in position on main line rails 23*a* and 23*b* (similar as would be the operation of main line rails 3*a* and 3*b*), and which may be appreciated in more detail from FIG. 5.

FIG. 4 also shows the overall construction of panel 22 (similar to panel 1) and its interconnection to panel 1 through bridging rail sections 13*a* and 13*b* and associated bridging rail frogs, such as 16*a* and 16*b* and their corresponding castings on the opposite ends of bridging rail sections 13*a* and 13*b*. Bridging rail frogs, such as 16*a* and 16*b* may optionally and preferably be provided with flangeways 16*c* and 16*d* to provide continuity of the rail paths by being aligned with the space between transitional internal castings 11*a* and 11*b* and raised guard portions 11*c* and 11*d*, as well as with the corresponding flangeways 10*c* and 10*d* of the external frog castings.

Figure 5:
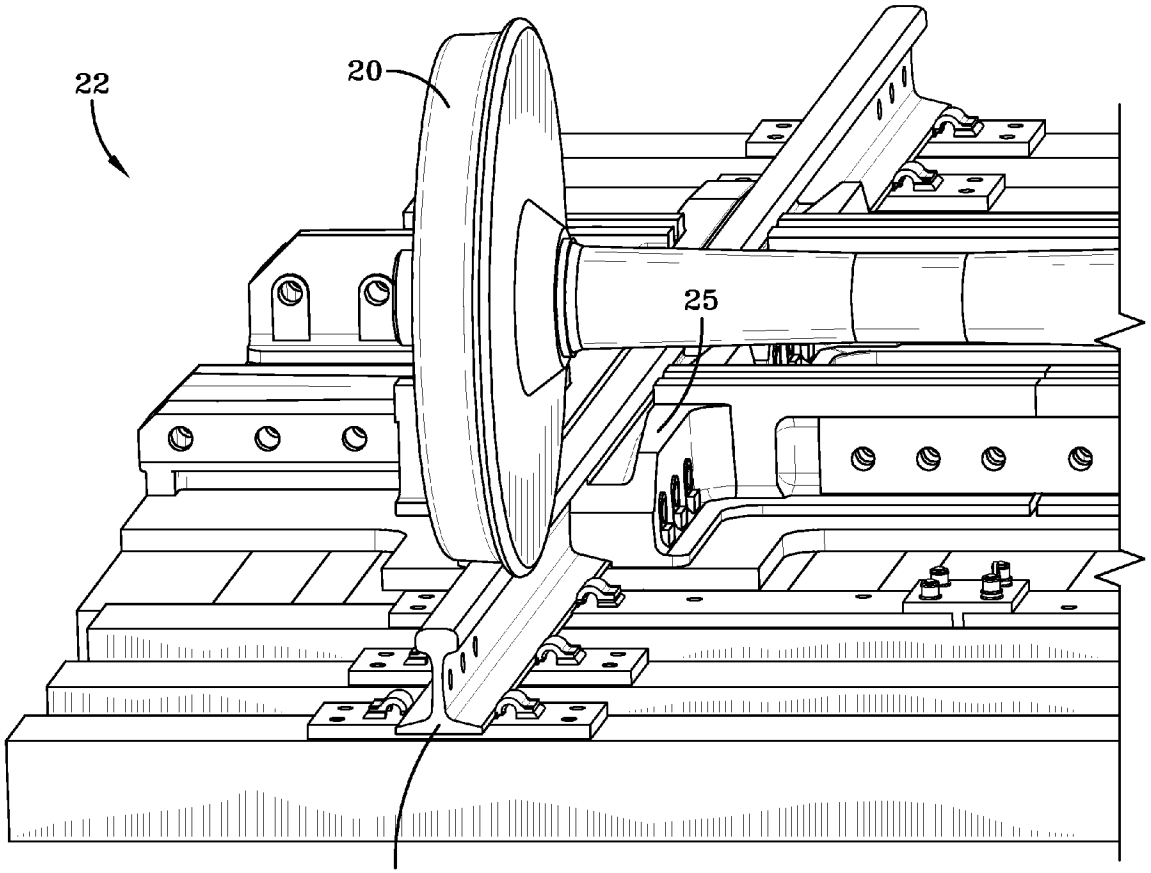
FIG. 5 is a detailed upper perspective view of a crossing panel in accordance with one embodiment of the present invention, and showing a rail wheel set in place.

FIG. 5 is a detailed upper perspective view of a crossing panel 22, taken along line 5-5 of FIG. 4, in accordance with one embodiment of the present invention, and showing a rail wheel set in place, and wherein like reference numerals otherwise refer to the same portions described herein. This view shows that, in operation, a rail wheel set such as rail wheel set 20 on main line rails 23*a* and 23*b* may move along direction A without a change in elevation and while being maintained in its path by wheel guides 24 and 25 (as it passes through the rail gap to enter the corresponding transition zone), and by wheel guides 26 and 27 (as it passes through the opposing rail gap to exit the corresponding transition zone).

Figure 6:
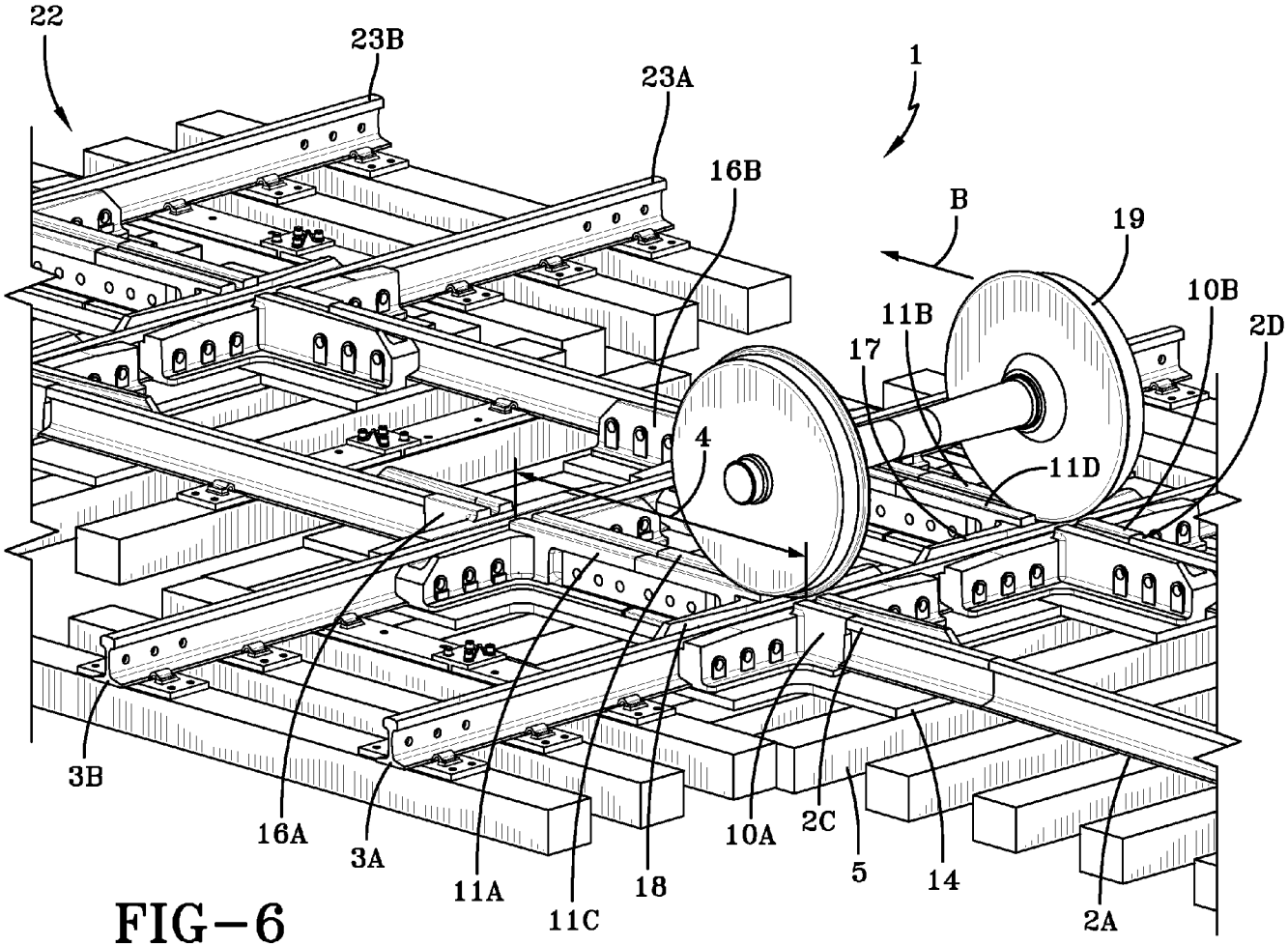
FIG. 6 is a detailed upper perspective view of a crossing panel in accordance with one embodiment of the present invention, and showing a rail wheel set in place.

FIG. 6 is a detailed upper perspective view of a crossing panel 1 in accordance with one embodiment of the present invention, and showing a rail wheel set 19 in place as it enters transition zone 4 moving along direction B, having been elevated from the base elevation (typically though not always horizontal) by action of the vertical angling of crossing line rails 2*a* and 2*b*, which elevation is maintained by external frogs 10*a* and 10*b* up to the point of entry into transition zone 4, and by transitional internal castings 11*a* and 11*b* as the rail wheel set 19 moves through transition zone 4 while continuing along direction B. FIG. 4 shows rail car wheel set 19 in the transition zone 4 as it continues along direction B while being borne and supported by transitional internal castings 11*a* and 11*b*.

After exiting the transition zone 4, rail car wheel set 19 continues along direction B at the same elevation as it exits transition zone 4 to be borne by bridging rail sections 13*a* and 13*b* (in the case of a dual crossing embodiment) to continue through the transition zone of panel 22 and finally onto a set of crossing line rails (not shown), mirroring crossing line rails 2*a* and 2*b*, that return the rail car wheel set 19 to the base elevation.

In the case of a single crossing embodiment (where the only crossing is that of panel 1), bridging rail sections 13*a* and 13*b* would simply be replaced by a set of crossing line rails mirroring crossing line rails 2*a* and 2*b*, that would return the rail car wheel set 19 to the base elevation.

Figure 7:
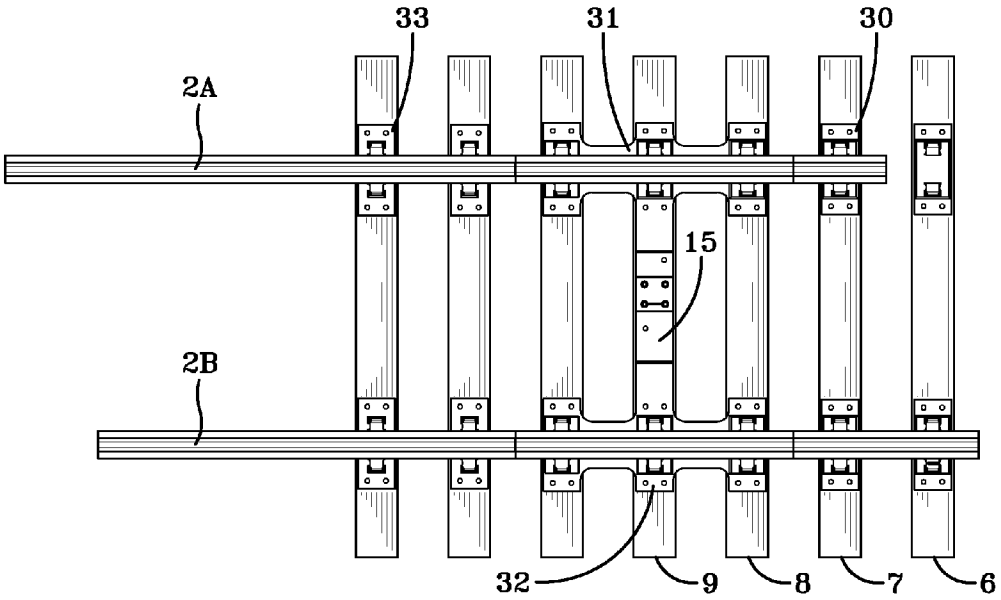
FIG. 7 is a detailed plan view of a portion of crossing panel, in accordance with one embodiment of the present invention.

FIG. 7 is a detailed plan view of a portion of crossing panel 1 wherein like reference numerals otherwise refer to the same portions described herein. This Figure shows a plurality of railroad ties, such as railroad ties 6-9, that support the crossing line rails; i.e., left hand rail 2*a* and right hand rail 2*b*, such that they are angled upwardly from the base elevation toward the first main line rail 3*a*, and terminating such that their tread bearing surfaces at their respective terminal ends is at a height above the crown of the first main line rail encountered. FIG. 7 shows full riser plate 30, left hand riser plate 31, right hand riser plate 32, base plate 33, and gauge plate 15. It will be appreciated that the riser plates may be supported by one or more railroad ties.

Figure 8:
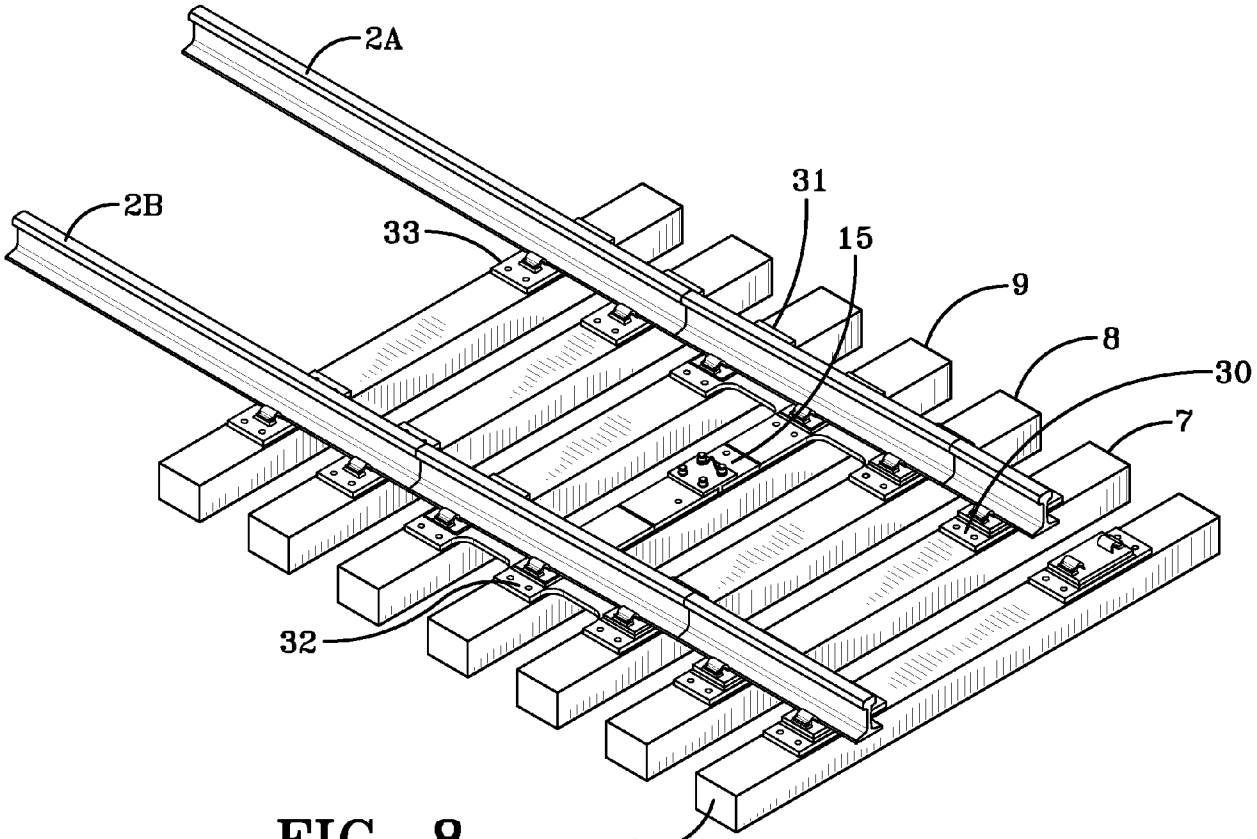
FIG. 8 is a detailed perspective view of a portion of crossing panel, in accordance with one embodiment of the present invention.

FIG. 8 is a detailed perspective view of a portion of crossing panel 1 showing a plurality of railroad ties and the riser plates in place wherein like reference numerals otherwise refer to the same portions described herein.

Figure 9:
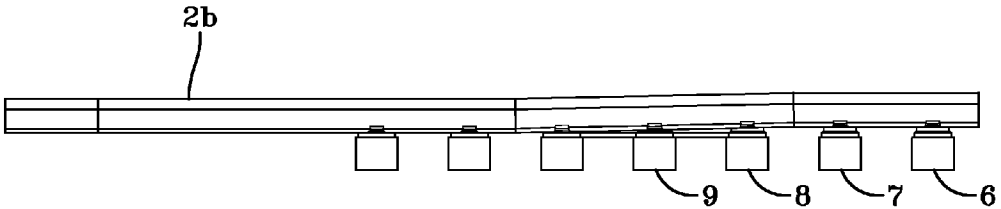
FIG. 9 is a detailed elevation view of a portion of crossing panel, in accordance with one embodiment of the present invention.

FIG. 9 is a detailed elevation view of a portion of crossing panel 1 showing a plurality of railroad ties and the riser plates in place wherein like reference numerals otherwise refer to the same portions described herein. From this Figure one can appreciate that the upwardly angled crossing line rails 2*a* and 2*b* perform all or substantially all of the lift function over a length of preferably approximately 5-10 tie lengths (generally at least 2 and up to 15), though a greater or lesser run may be used in other applications. In this particular embodiment, the vertical lift provided by this portion of the crossing is about 1.25 inches over a length of about 5.0 feet. It will be understood that this ratio may be varied depending upon the operating speed and general environment of the crossing. Generally speaking, the vertical lift provided by the rail portion of the crossing may be in the range of from about 1.00 inches to 2.50 inches over a length of from about 3.0 feet to about 10.00 feet.

Figure 10:
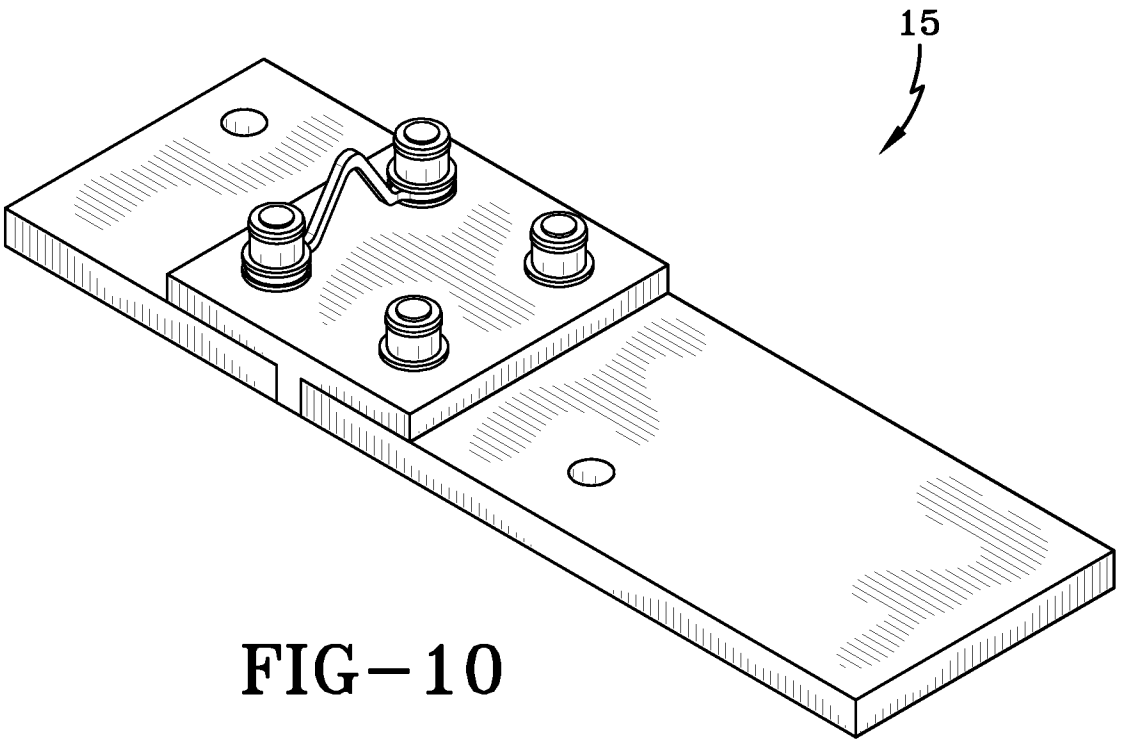
FIG. 10 is a detailed perspective view of a gauge plate that may be used in accordance with one embodiment of the present invention.

FIG. 10 is a detailed view of a gauge plate 15 used in accordance with the present invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

The following patent documents generally describe crossing, frog and rail systems with which the present invention may be used, and such references are hereby incorporated herein by reference:

| | |
|---|---|
| 7,377,471 | Method and system for opening and securing a railroad frog |
| 7,121,513 | Cross frog for a set of track points, provided with an end of position-retaining device |
| 7,083,149 | Cross frog |
| 6,994,299 | Railroad crossing apparatus having improved rail connection and improved flangeway floor geometry and method incorporating the same |
| 6,732,980 | Railway frog wear component |
| 6,543,728 | Cross frog |
| 6,340,140 | Railroad frog for switch points and crossings |
| 6,286,791 | Railroad spring wing frog with hold-open and shock dampening elements |
| 6,276,642 | Railroad spring wing frog assembly |
| 6,266,866 | Frog insert and assembly and method for making frog assembly |
| 6,224,023 | Railroad spring frog assembly |
| 6,177,205 | Process for producing a permanent way component and such a component |
| 6,164,602 | Railroad frog assembly with multi-position holdback |
| 6,158,697 | Railroad frog assembly with latch holdback |
| 6,138,958 | Spring rail frog |
| 5,810,298 | Railroad spring frog assembly |
| 5,806,810 | Spring rail frog having switchable magnet for holding wing rail open |
| 5,782,437 | Spring rail frog having bendable rail with modified cross-section |
| 5,743,496 | Railroad frog crossing bolt and nut assembly for clamping railroad rail sections together |
| 5,598,993 | Pseudo heavy point frog assembly |
| 5,595,361 | Wing rail hold-down |
| 5,560,571 | Reversible wing insert frog |
| 5,544,848 | Railroad spring frog |
| 5,531,409 | Flange bearing bolted rail frog for railroad turnouts and crossings |
| 5,522,570 | Rail section |
| 5,375,797 | Compound geometry rail switch |
| 5,184,791 | Frog tip that can be shifted relative to the wing rails |
| 5,082,214 | Crossing frog with a moving point |
| 5,042,755 | Process for producing a crossing frog with a moving point |
| 4,982,919 | Reversing device for movable parts of a railway switch |
| 4,953,814 | Railway switch comprising a frog having a movable main point and auxiliary point |
| 4,948,073 | Turnout with closing frog |
| 4,908,993 | Grinding machine for reprofiling railheads |
| 4,756,477 | Plate for supporting railway rails and a track assembly using it |
| 4,637,578 | Railroad frog having movable wing rails |
| 4,624,428 | Spring rail frog |
| 4,589,617 | Frog for switches |
| 4,516,504 | Cross-over track structure for wheeled pallets |
| 4,514,235 | Frog, in particular frog point, for rail crossing or rail switches as well as process for producing same |
| 4,469,299 | Railway turnouts |
| 4,169,745 | Method of joining frogs of wear-resisting manganese steel castings to rails of carbon steel |
| 4,168,817 | Rail switch |
| 4,159,090 | Railway switch for vignoles rails |
| 4,144,442 | Process for producing a component part of a railway switch or a railway crossing and component cart of railway switches or railway crossings produced by such process |
| 4,015,805 | Railway switch or railway crossing |
| 20100270436 | ADJUSTMENT DEVICE IN RAILROAD SWITCHES |
| 20070007394 | System, method, and apparatus for railroad turnout and derail lift frog |

-continued

| | |
|---|---|
| 20060202047 | Use of k-spiral, bend, jog, and wiggle shapes in design of railroad track turnouts and crossovers |
| 20050145754 | Cross frog |
| 20050067535 | Cross frog for a set of track points, provided with an end of position-retaining device |
| 20040124316 | Railroad crossing apparatus having improved rail connection and improved flangeway floor geometry and method incorporating the same |
| 20040065784 | Railway frog wear component |

What is claimed is:

1. A crossing panel for accommodating rolling of wheels of a railcar wheel set of a train, each wheel having a flange and a tread surface, across a crossing point of crossing line rails over an intersecting pair of rails, where the crossing line is at a base elevation, said crossing panel comprising:

a. a pair of crossing line rails, each said crossing line rail having a crossing rail tread bearing surface and a terminal end;

b. a pair of main line rails intersecting said crossing line rails and comprising a first main line rail and a second main line rail, each having a crown, and defining a transition zone thereabove;

c. a plurality of railroad ties adapted to support said crossing line rails; said crossing line rails supported by said ties and angled upwardly from the base elevation toward said first main line rail and terminating such that their tread bearing surfaces at their respective terminal ends are at a height above said crown of said first main line rail; and d. an external frog, being aligned with and secured to each said respective terminal end of said crossing line rails, each said external frog having an external frog tread bearing surface at substantially above said first main line rail crown, each said external frog having a flange pathway having a transitional flangeway adapted to engage the flange of a railcar wheel of a train wheel set passing therethrough, such that the tread of said wheel is substantially above the level of said first main line rail crown and contacts said external frog tread bearing surface; and e. an internal casting disposed between said pair of main line rails and respectively aligned with each of said crossing line rails, said internal castings each having a crown maintained at a height sufficient to maintain said railcar wheel of a train wheel set above said main line rails.

2. A panel according to claim 1, wherein said crossing rails are canted toward one another.

3. A panel according to claim 1, wherein said plurality of railroad ties having a series of at least two ties disposed beneath said pair of crossing line rails, said series of ties being provided with respective riser plates adapted to maintain said pair of crossing line rails angled from the base elevation and upward toward said first main line rail.

4. A panel according to claim 3, wherein said crossing rails are canted toward one another, and wherein said respective riser plates are adapted to maintain said crossing line rails in a canted position.

5. A panel according to claim 1, wherein said pair of external frog castings are canted toward one another.

6. A panel according to claim 1, wherein said transitional guide castings are canted toward one another.

7. A panel according to claim 1, wherein said transitional guide castings further comprise a raised guard portion disposed along one side thereof for retaining a train wheel in a proper position with respect to said transitional guide castings.

8. A crossing panel for accommodating rolling of wheels of a railcar wheel set of a train, each wheel having a flange and a tread surface, across a crossing point of crossing line rails over an intersecting pair of rails, where the crossing line is at a base elevation, said crossing panel comprising:

a. a first pair of main line rails comprising a first main line rail and a second main line rail, each having a crown, and defining a first transition zone thereabove;

b. a second pair of main line rails comprising a third main line rail and a fourth main line rail, each having a crown, and defining a second transition zone thereabove; said first pair of main line rails and said second pair of main line rails being substantially parallel and said first main line rail and fourth main line rail being in outer positions;

c. a crossing line rail set approaching respective each of said first main line rail and said fourth main line rail, each said crossing line rail set comprising:

i. a pair of crossing line rails, each said crossing line rail having a crossing rail tread bearing surface and a terminal end;

ii. a plurality of railroad ties adapted to support said crossing line rails; said crossing line rails supported by said ties and angled upwardly from the base elevation toward said respective main line rail and terminating such that its tread bearing surface and flange at its terminal end is at a height above said crown of said respective main line rail; and iii. a pair of external frogs, each external frog being aligned with and secured to one of said respective terminal ends of said crossing line rails, each said external frog having an external frog tread bearing surface substantially above the level of said respective main line rail crown, each said external frog having a flange pathway to engage the flange of a railcar wheel of a train wheel set passing therethrough, such that the flange of said wheel is above the level of said respective main line rail crown;

d. transitional guide castings disposed between each of said first and second pairs of said main line rails respectively aligned with said crossing line rails, said transitional guide castings being substantially horizontal and each having a crown maintained at a height sufficient to maintain said tread and flange of said railcar wheel of a train wheel set above said main line rails; and e. bridging rail sections disposed between said second and third main line rails and aligned with said crossing line rails, said bridging rail sections being substantially horizontal and each having a crown maintained at a height sufficient to maintain said railcar wheel of a train wheel set above said crossing line rails.

9. A panel according to claim 8, wherein said crossing rails are canted toward one another.

10. A panel according to claim 8, said plurality of railroad ties having a series of at least two ties disposed beneath each set of crossing line rails, said series of ties being provided with respective riser plates adapted to maintain each set of crossing line rails angled from the horizontal.

11. A panel according to claim 10, wherein said crossing rails are canted toward one another, and wherein said respective riser plates are adapted to maintain said crossing line rails in a canted position.

12. A panel according to claim 8, wherein said external frogs are canted toward one another.

13. A panel according to claim 8, wherein said transitional guide castings are canted toward one another.

14. A panel according to claim 8, wherein said transitional guide castings further comprise a flange pathway having a flangeway and a raised guard portion disposed along one side thereof for retaining a train wheel in a proper position with respect to said transitional guide castings.

15. A panel according to claim 8, wherein said bridging rail sections are canted toward one another.

16. A panel according to claim 8, wherein said bridging rail sections have bridging rail terminal ends and, associated with each said bridging rail terminal end, a bridging rail frog, each bridging rail frog being aligned with and secured to said respective bridging rail terminal end, each said bridging rail frog having a bridging rail frog tread bearing surface at substantially the same level of said main line rails, each said bridging rail frog having a flange pathway having a bridging flangeway.

* * * * *